United States Patent [19]

Selman

[11] Patent Number: 4,852,282

[45] Date of Patent: Aug. 1, 1989

[54] MAGNETIC CALENDAR FRAME

[75] Inventor: William A. Selman, Decatur, Ga.

[73] Assignee: S & D Products, Inc., Greenville, S.C.

[21] Appl. No.: 65,583

[22] Filed: Jun. 23, 1987

[51] Int. Cl.[4] ..... A47G 1/06; G09F 1/10

[52] U.S. Cl. ..... 40/159; 40/600

[58] Field of Search ..... 40/107, 152, 10 A, 10 B, 40/10 D, 156, 159, 600, 904, 594, 621; 434/408, 416, 421

[56] References Cited

U.S. PATENT DOCUMENTS

| | | | |
|---|---|---|---|
| 1,757,287 | 5/1930 | Bildstein | 434/408 |
| 1,803,234 | 4/1931 | Clark | 40/10 A |
| 1,956,527 | 4/1934 | DeGroot | 40/159 |
| 2,093,598 | 9/1937 | Clark | 40/10 A |
| 2,169,290 | 8/1939 | Rossi | 40/159 |
| 2,193,296 | 3/1940 | Pienzak | 40/159 |
| 2,611,369 | 9/1952 | Herrick | 40/159 |
| 2,925,675 | 2/1960 | Lumpkin | 40/10 D |
| 3,400,477 | 9/1968 | Brown | 40/156 |
| 3,553,864 | 1/1971 | Karlyn et al. | 434/408 |
| 3,642,191 | 2/1972 | Roof | 434/408 |
| 3,696,532 | 10/1972 | Nahon | 40/122 |
| 3,698,111 | 10/1972 | Smith | 40/600 |
| 3,826,026 | 7/1974 | Bevan | 40/600 |
| 3,943,645 | 3/1976 | Viesturs | 40/10 D |
| 4,305,216 | 12/1981 | Skelton | 40/10 B |
| 4,310,978 | 1/1982 | Stern | 40/600 |
| 4,413,434 | 11/1983 | Rupert et al. | 40/159 |
| 4,545,140 | 10/1985 | Winston | 40/10 D |
| 4,703,571 | 11/1987 | McCarthy | 40/107 |

FOREIGN PATENT DOCUMENTS

| | | | |
|---|---|---|---|
| 2239351 | 2/1975 | France | 434/408 |
| 2582131 | 11/1986 | France | 40/594 |
| 111183 | 6/1984 | Japan | 40/594 |
| 1565468 | 4/1980 | United Kingdom | 434/416 |

OTHER PUBLICATIONS

Cattails, "Hold Everything", 1985.

*Primary Examiner*—Gene Mancene
*Assistant Examiner*—Michael Lynch
*Attorney, Agent, or Firm*—Dority & Manning

[57] ABSTRACT

A calendar frame for attachment to an upper freezer door of a refrigerator/freezer unit is disclosed. The calendar frame receives a calendar sheet and comprises a calendar cover configured for substantially covering the calendar sheet. The calendar cover has a transparent portion configured for viewing the calendar sheet therethrough. A writing surface is provided the calender cover which is adapted for erasably receiving a writing ink thereon. Magnetic calendar support means are attached to the calendar cover for magnetically attaching the calendar cover to the freezer door and for supporting the calendar sheet therebetween such that the calendar sheet is visible through the transparent portion of the calender cover. Erasable ink writings may be made on the calendar cover to correspond to date blocks on the calendar sheet, thereby allowing the same calendar sheet to be continuously reused.

4 Claims, 2 Drawing Sheets

MAGNETIC CALENDAR FRAME

BACKGROUND OF THE INVENTION

This invention relates to a transparent magnetic calendar frame attachable to a metal surface for receiving a calendar sheet therebetween.

Conventional calendars are typically constructed of paper and are generally placed on a horizontal surface, such as a table or desk top, or a vertical surface, such as a wall, cabinet, refrigerator, or the like. Generally, notations are made on the calendar for certain days of a particular month. After the month has passed, the calendar is advanced to another sheet which represents the next month. At the end of a calendar year, a new calendar is typically required to be purchased to replace the old calendar since the relationship between the week, days, and dates of the next year are usually different.

In order to eliminate the necessity of buying a new calendar every year, or even a new calendar sheet for each new month, it would be desireable to have some calendar means which was reusable. Certain calendars have been developed which have markings representing the days and weeks of the month wherein the user fills in the actual name of the month and the dates thereof corresponding to the particular days of the week. Such calendars have been produced with a coated surface such that an ink pen may be used to make the markings for a particular month, and then the markings can be erased after the month has passed. These calendars are typically attached to a surface by adhesive means such as tape or by other fastening means such as nails, hangers, screws or the like. Such attachment means are generally not reuseable and/or require for permanent damage to be done to the mounting surface, such as by holes, adhesive residue, etc.

It would thus be desireable to have a calendar which is both reuseable and readily attachable to a mounting surface through reuseable attachment means which do not damage the mounting surface.

SUMMARY OF THE INVENTION

The present invention recognizes and addresses such drawbacks of the prior calendars. Hence, it is a general object of the present invention to provide a calendar which is both reuseable and which may be readily attached to a mounting surface.

It is another object of the present invention to provide a calendar frame which is magnetically attachable to a surface and which receives a reuseable calendar sheet therein.

It is yet another object of the present invention to provide a calendar frame for receiving a calendar sheet wherein the calendar frame has a transparent portion for covering the calendar sheet which can be erasably marked on with ink for corresponding to the dates of the calendar sheet received by the calendar frame.

Various combinations of the presently disclosed features may be provided in a given embodiment thereof in accordance with this invention. Generally, one such exemplary embodiment of the present invention includes a calendar frame for receiving a calendar sheet and for attachment to an attachment surface capable of attraction by magnetic forces. The calendar frame comprises a calendar cover configured for substantially covering a calendar sheet, the calendar cover having a transparent portion configured for viewing the calendar sheet therethrough. The transparent portion has a calendar sheet facing surface on one side thereof for facing the calendar sheet when the calendar sheet is covered by the calendar cover, and on the opposite side thereof, a writing surface adapted for erasably receiving a writing ink. The writing surface allows writing to be erasably performed thereon corresponding to the calendar sheet covered by the calendar cover.

Magnetic calendar supports are attached to the calendar sheet facing surface of the calendar cover for magnetically attaching the calendar cover to an attachment surface capable of attraction by a magnetic forces. The magnetic calendar supports also support the calendar sheet between the calendar cover and the attachment surface such that the calendar sheet is adjacent the calendar sheet facing surface of the calendar cover and is visible through the transparent portion of the calendar cover.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, in which.

DESCRIPTION OF THE PREFERRED EMBODIMENT

Figure 1:
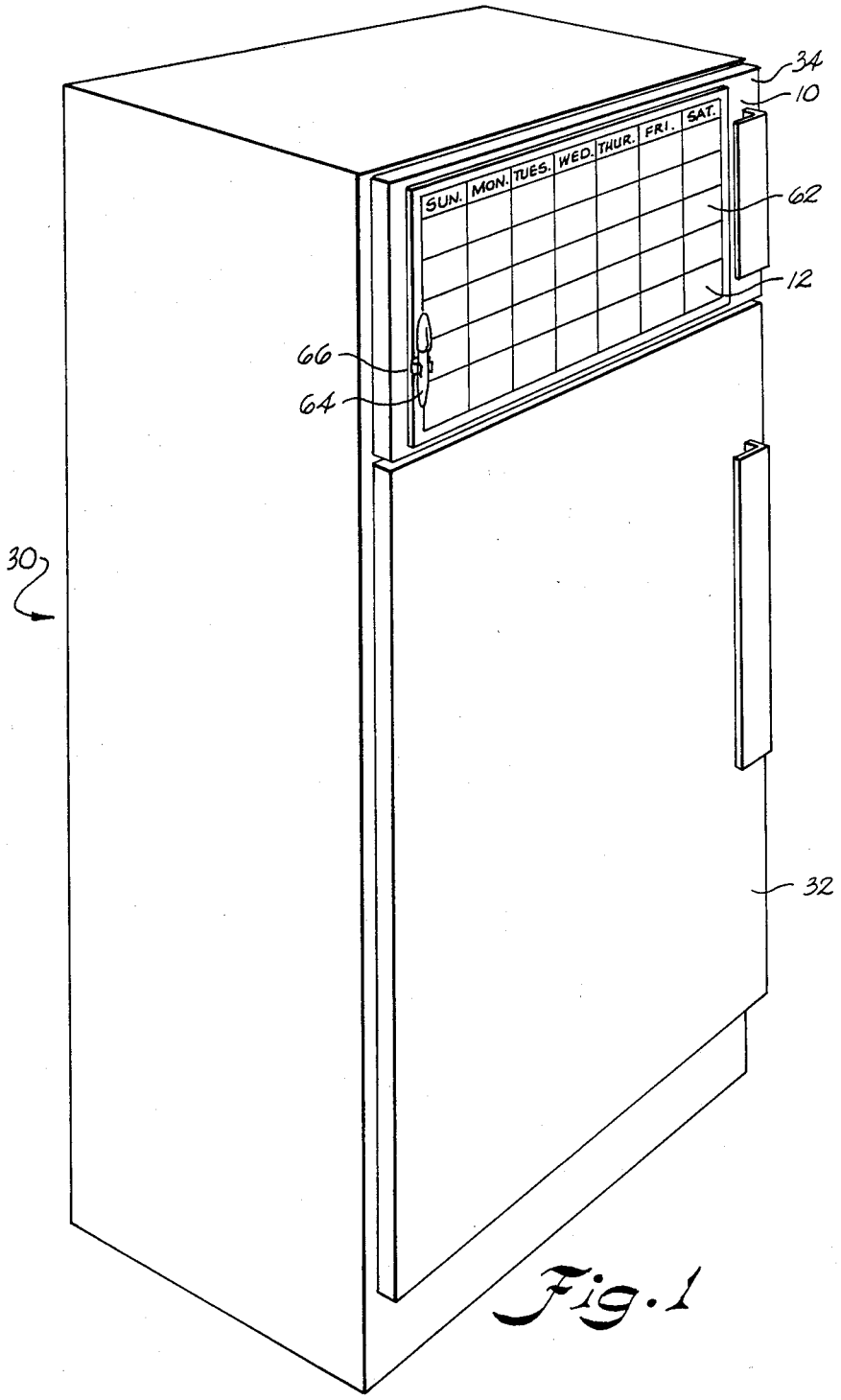
FIG. 1 is a perspective view of a conventional refrigerator-freezer unit having a calendar frame constructed in accordance with the present invention attached to the freezer door.

Referring to the drawings in detail, wherein like reference characters represent like elements and/or features throughout the various views, a preferred embodiment of the calendar frame of the present invention is designated generally in FIG. 1 of the drawings by the reference character 10. Calendar frame 10 includes a calendar cover 12 having magnetic supports 14 attached thereto.

Calendar cover 12 is preferably constructed of transparent acrylic material, although any other suitable transparent plastic material or glass could also be used. Calendar cover 12 is sized accordingly for substantially covering the calendar sheet 16 which is insertable behind calendar cover 12.

Figure 2:
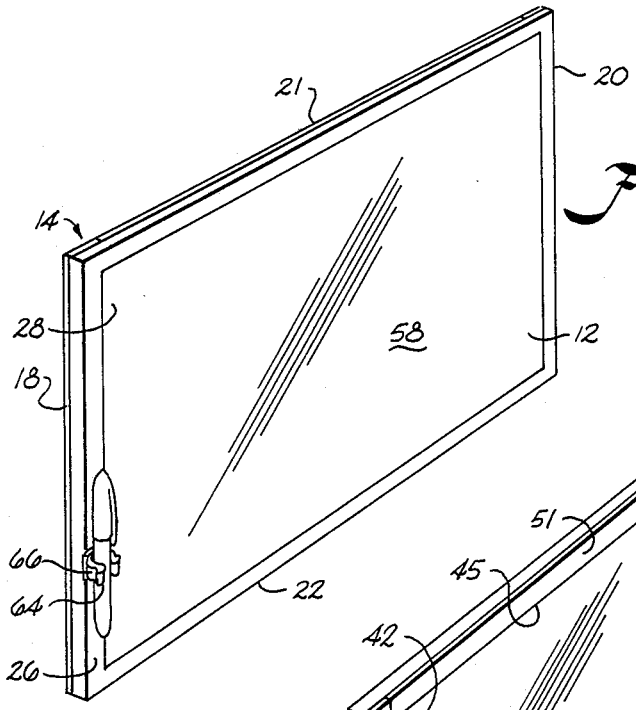
FIG. 2 is a perspective frontal view of a calendar frame constructed in accordance with the present invention.
Figure 3:
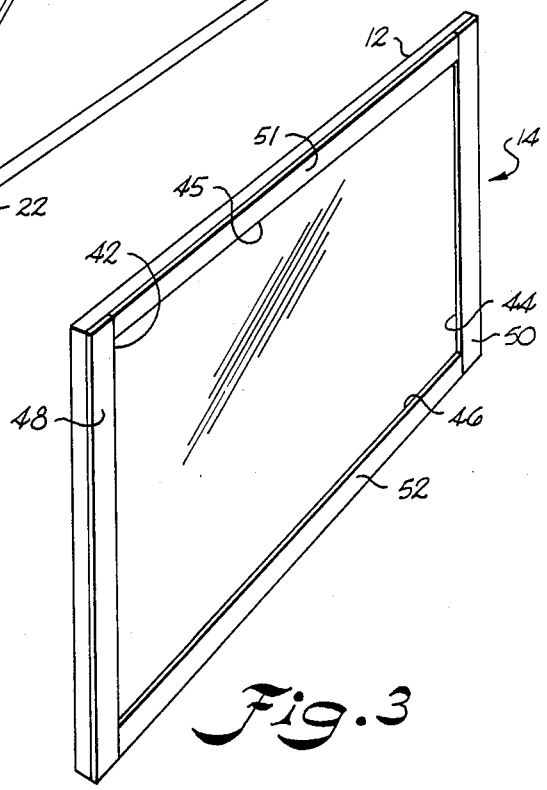
FIG. 3 is a perspective rearward view of a calendar frame constructed in accordance with the present invention.

Magnetic supports 14 are provided along two side edges 18, 20 and top and bottom edges 21, 22 of inner surface 24 of calendar cover 12. Magnetic supports 14 are preferably constructed of flexible strip magnets, which are well known. Magnetic supports 14 may extend the full length of edges 18, 20, 21, 22 as illustrated in FIGS. 2 and 3, or they may extend along only partial lengths of edges 18, 20, 21, 22. Alternately, magnetic supports 14 may be provided along only two or three edges of calendar cover 12, if desired. Magnetic supports 14 may be suitably attached to inner surface 24 of calendar cover 12 by adhesive means such as glue, or by mechanical fasteners such as rivets, screws, or the like. A screen printed border 26 is provided on the outer surface 28 of calendar cover 12 and is preferably opaque for hiding magnetic supports 14 from view.

Figure 4:
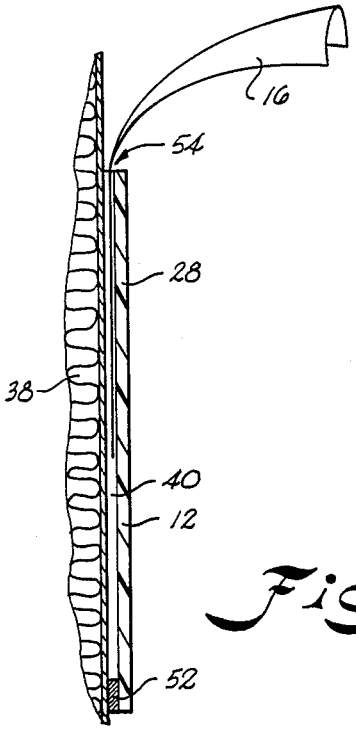
FIG. 4 is a sectional view of an alternate embodiment of a calendar frame constructed in accordance with the present invention illustrating a calendar sheet being inserted therein.

Calendar frame 10 is attachable to any surface capable of attraction by magnetic forces such as metal walls, cabinets, doors or the like. One such surface where calendar frame 10 finds particular utility is on a conventional refrigerator/freezer unit 30 as illustrated in FIG. 1. Refrigerator/freezer unit 30 includes a refrigerator door 32 and a freezer door 34. Freezer door 34 is provided with a metal surface 36, behind which is provided insulation 38, as shown in FIG. 4.

Upon magnetic attachment of calendar frame 10 to freezer door 34, a calendar sheet receiving compartment 40 is provided adjacent inner surface 24 of calendar cover 12 and the outer surface of the freezer door 34. The calendar sheet receiving compartment 40 is defined by the calendar sheet facing inner surface 24 of calendar cover 12, the outer surface 36 of freezer door 34, and edges 42, 44, 45, 46 of flexible magnetic strips 48, 50, 51, 52. In an alternate embodiment of the present invention, only three magnet strips are used, and calendar sheet compartment 40 includes an opening 54 defined adjacent upper edge 21 of calendar frame 10 for receiving calendar sheet 16, as shown in FIG. 4. After calendar sheet 16 has been inserted into calendar sheet compartment 40, the days of the week and spaces for the days of the month printed on calendar sheet 16 are visible through a transparent portion 58 of calendar cover 12 defined by border 26, as shown in FIG. 1.

Outer surface 28 of calendar cover 12 is configured for erasably receiving marking ink such that the dates of the month may be marked on outer surface 28 corresponding to the printed blocks 62 of calendar sheet 16, which correspond to particular days of the month. One suitable marking pen 64 for writing on outer surface 28 of calendar cover 12 which has ink which can be easily wiped off of outer surface 28 is a "VIS-A-VIS" (trademark) marking pen manufactured by Sanford Corporation of Bellwood, Ill. Pen 64 is releasably held to by a clip 66 attached to calendar cover 12. Through use of the erasable ink of such a marking pen, the dates of a particular month can be marked on outer surface 28 and then wiped off when that month has passed so that new dates can be marked on outer surface 28 to correspond to the next month. As a result, only one calendar sheet 16 is required throughout the year, and from year to year. Thus, only one calendar sheet 16 need be purchased to provide a calendar which theoretically never needs to be replaced.

Calendar frame 10 can further be used to eliminate refrigerator clutter which often occurs when various notes, memos, and the like are attached to the refrigerator door, which is a common message center in the home. With calendar frame 10, notes, memos, and the like can be marked directly on outer surface 28 thereof and then erased subsequently when their usefulness has passed. Further, the magnetic attachment of calendar frame 10 to freezer door 34 allows for easy attachment of calendar frame to and removable from freezer door 34 without need of additional fastening means.

It is to be understood that calendar frame 10 could be attached to any surface which is capable of attraction by the magnetic forces, and is not limited to attachment to a refrigerator/freezer door. Calendar frame 10 could be disposed horizontally as illustrated in FIGS. 1–4, or could be disposed vertically if desired. An opening along either an upper or side edge (not shown) for receiving a calendar or other sheet therein could be provided if desired. Calendar sheet 16 can be printed on one side thereof with a horizontally disposed calendar, for use with the calendar frame when in a horizontal disposition, and printed on the other side with a vertically disposed calendar, for use with the calendar frame when in a vertical disposition. Further, the calendar frame can be used for providing an erasable cover for various items such as docketing boards, scheduling boards, "to do" lists, telephone lists, recipes, etc.

EXAMPLE

A calendar frame 10 constructed as follows has been found to provide desireable results. Regarding calendar cover 12, it is preferably 17 inches wide and 26 inches long. This size has been found to be ideal for many freezer doors of refrigerator/freezer units. However, another size of calendar cover, being 14 inches wide and 24 inches long has also been found to be adequate, particularly for smaller freezer doors of the refrigerator/-freezer units. Calendar cover 12 is preferably constructed of clear acrylic, 0.060 inches thick. The flexible magnetic strips are preferably 0.5 inches wide, 0.030 inches thick. It is to be noted that the flexible magnetic strips do not have to extend entirely along side edges 18, 20 and top and bottom edges 21, 22 of calendar cover 12, but also perform well if they extend along only a portion of each edge 18, 20, 21, 22. For example, for a calendar cover which is 17 inches wide and 26 inches long, the flexible magnetic strips may each be 16 inches long for attachment to each edge 18, 20, 21, 22 of calendar cover 12. The flexible magnetic strips are attached to calendar cover 12 by a suitable adhesive.

From the foregoing, it can be seen that a calendar cover constructed in accordance with the present invention provides a means for allowing a single calendar sheet to be reused month after month and for allowing the calendar sheet to be easily provided, in removable fashion, to a metal surface such as a freezer door of a refrigerator/freezer unit.

While one preferred embodiment of the invention has been described using specific terms, such description is for illustrative purposes only, and it is to be understood that changes and variations to such embodiment, including but not limited to the substitution of equivalent features or parts, and the reversal of various features thereof, may be practiced by those of ordinary skill in the art without departing from the spirit or scope of the following claims.

What is claimed is:

1. A removably supported calendar frame for use with a perpetual calendar, comprising:

a generally planar, transparent member, said planar member being relatively thick and rigid, and having respective planar surfaces on opposite sides thereof;

magnetic support means, comprising a plurality of strip magnets rigidly attached respectively along at least a portion of plural edges of one of said planar surfaces of said planar member, for magnetically and removably supporting said planar member on a magnetically-attractable support surface in spaced relation thereto, said strip magnets having a predetermined thickness so as to define a fixed-form planar compartment between such support surface and said one planar surface adapted for receipt and support therein of a sheet with perpetual calendar indicia thereon facing said one planar surface, wherein said compartment has a thickness greater than that of such sheet and fully supports such sheet therein with one edge of such sheet resting against at least one of said strip magnets, and further wherein the other of said planar surfaces is adapted for marking thereon with removable ink, which marking may be selectively aligned with perpetual calendar indicia of such sheet supported in a selected orientation on the opposite side of said planar member of transparent material, whereby temporary markings may be entered on said other planar surface in alignment with indicia removably and selectively supported therebeneath.

2. A calendar frame as defined in claim 1, wherein said transparent planar member is substantially rectangular for covering a substantially rectangular calendar sheet.

3. A calendar frame as defined in claim 1, wherein said support means comprise flexible strip magnets situated respectively along at least three edges of said one planar surface.

4. A calendar frame as defined in claim 3, further comprising an opaque border defined about said one planar surface for covering said flexible strip magnets from view and for defining a transparent portion of said generally transparent planar member for viewing of a perpetual calendar sheet supported therebehind in alignment with the temporary markings entered on said generally transparent planar member.

* * * * *